US005738456A

United States Patent [19]

Tanahashi et al.

[11] Patent Number: 5,738,456

[45] Date of Patent: Apr. 14, 1998

[54] PRINTER DEVICE

[75] Inventors: Makoto Tanahashi; Koichi Numata, both of Kanagawa; Takahiro Tsuge, Saitama, all of Japan

[73] Assignee: Sony Corporation, Japan

[21] Appl. No.: 696,182

[22] Filed: Aug. 13, 1996

[30] Foreign Application Priority Data

Aug. 31, 1995 [JP] Japan ..... 7-223997

[51] Int. Cl.[6] ..... B41J 13/10

[52] U.S. Cl. ..... 400/642; 400/622; 400/600

[58] Field of Search ..... 400/622, 625, 400/642, 713, 600, 691, 693.1, 693

[56] References Cited

U.S. PATENT DOCUMENTS 4,448,559 5/1984 Matsuda et al. ..... 400/600.3
5,213,427 5/1993 Grosse et al. ..... 400/625
5,527,122 6/1996 Carter ..... 400/713
5,567,068 10/1996 Egashira et al. ..... 400/642
5,600,361 2/1997 Dirx ..... 400/693.1

*Primary Examiner*—John S. Hilten
*Attorney, Agent, or Firm*—Ronald P. Kananen

[57] ABSTRACT

A printer device for performing printing by a thermal head using a color ink ribbon cassette 60, in which the device may be reduced in size. A sheet guide plate 2 is mounted on a lid 1 that can be opened and closed. When a printing sheet P is moved back and forth for multi-color printing, the sheet P is moved within the range of the lid 1 below the sheet guide plate 2. During non-use time, the lid 1 is closed, whereby the device becomes smaller in size than the range of movement of the printing sheet P.

18 Claims, 12 Drawing Sheets

PRINTER DEVICE

BACKGROUND OF THE INVENTION

1. Field of the Invention

This invention relates to a printer device including a printing mechanism having an ink ribbon cassette and a thermal head for printing on a printing sheet.

2. Description of the Related Art

There has hitherto been proposed a printer device for effecting color printing on a printing sheet using a color ink ribbon having inks of three colors of yellow (Y), magenta (M) and cyan (C) and a thermal head for transcribing the inks of the color ink ribbon on the sheet.

In such printer device, a component of the first color, such as yellow, of a given image is first printed. Then, a component of the second color of the image, such as magenta, followed by a component of a third color of the image, such as cyan, is printed to complete the image.

When effecting printing by ink transcription with the thermal head, the printing sheet is moved relative to the thermal head, so that the sheet is moved at last thrice on the same locus of movement with respect to the thermal head.

In a known type of this printer device, a sheet feed port is provided in a main body portion of the printer device, and the sheet is inserted by a manual operation via the sheet feed port into the main body portion. A sheet guide plate for guiding the printing sheet is provided within the main body portion or a portion of the main body portion.

As shown in FIG. 1, such a printer device is fed via a video cable 208 with video signals from a video reproducing apparatus 205, at the same time as the video signals are sent to a video monitoring device 203 via a video cable 204. As the video monitor device 203, a dedicated display or the like is used in addition to a television receiver.

If the user desires to print a picture based on the video signals outputted by the video reproducing apparatus 205, the printing sheet P (FIG. 2) is fed by a manual operation into the sheet feed port of the printer device 201 and a printing switch 202 is pressed for commanding printing.

This causes a picture corresponding to the video signals outputted by the video reproducing apparatus 205 to be printed on the printing sheet. The printed sheet P is discharged via the sheet discharge opening of the printer device 201.

In the above printer device 201, the sheet P inserted into the sheet feed port is moved back and forth, as it is supported by a sheet guide plate within the main body portion of the printer device 201, as indicated by arrows a, b in FIG. 1, in order to effect printing. At this time, the sheet P is moved in sliding contact with the thermal head provided within the main body portion of the printer device 201 a plurality of number of times for effecting printing with the plural colors.

The sheet P, completely printed with respective colors, is discharged via the sheet discharge port to outside of the main body portion of the printer device 201, as indicated by arrow c in FIG. 1.

With the above printer device 201, the printing sheet P is inserted into the main body portion of the printer device 201 and, when the printing operation comes to a close, the sheet P is discharged via the sheet discharge port.

Thus, with the above printer device 201, the state of printing cannot be viewed during printing from outside, such that the printing state cannot be comprehended.

With the printer device 201, the sheet guide plate is provided inside the main body portion of the printer device 201 and, in case of color printing with a printing process with three or more colors, the sheet P is adapted not to be extruded out of the printer device when the sheet is returned to the printing start position for printing the second color and so forth. That is, with the present printer device, the sheet P is held within the main body portion 201 even if the sheet P is returned to the printing start position for printing the second or third colors.

The result is an increased size of the main body portion of the printer device 201.

It may be envisaged to provide a sheet guide plate for inserting the sheet P by manual operation into the sheet feed port so that the guide plate is protruded outside of the main body portion of the printer device and so that the sheet P being printed will be moved back and forth on the lower side of the sheet guide plate. This structure again increases the size of the printer device by an amount corresponding to the sheet guide plate.

It may also be envisaged to provide a sheet guide plate for inserting the sheet P into the main body portion of the printer device and to feed the sheet P into the main body portion by this sheet guide plate.

Since the sheet guide plate is provided separately from the main body portion in the present printer device, the main body portion may be reduced in size. However, when the sheet P is returned to the printing start position for printing the third color, the sheet P is extruded out of the main body portion of the printer device, such that the sheet P tends to be stopped by contact with the hand or finger of the user.

In addition, if the sheet guide plate is provided separately from the main body portion, there is a risk that the sheet guide plate be lost or destroyed.

SUMMARY OF THE INVENTION

It is therefore a primary object of the present invention to provide a printer device in which the printing sheet may be positively guided into the inside of the main body portion and which can be reduced in size.

It is another object of the present invention to provide a printer device in which the sheet can be checked from outside in the course of printing.

In one aspect, the present invention provides a printer device including (a) a main body portion having a printing unit, a sheet feed port for supplying printing sheets to the printing unit and an actuating switch controlling the operation of a control circuit adapted for driving the printing unit, and (b) a lid rotatably mounted on said main body portion; (c) the lid closing the sheet feed port of the main body portion and hiding the actuating switches for disabling the operation of the actuating switches at a first rotational position. The lid does not hide the actuating switches for enabling the operation of the control circuit at a second rotational position rotated a pre-set angle from the first rotational position. The lid supports the printing sheet supplied to the sheet feed port for guiding the sheet to the printing unit by driving means at the second rotational position.

In another aspect, the present invention provides a printer device defined as above wherein the main body portion has a sheet discharging port below the sheet feed port in the vicinity of the printing unit. The lid has a lid plate portion and a guide portion formed at a distance for forming a gap on the lid plate portion. The guide portion supports the printing sheet supplied to the sheet supply port and guides the sheet to the printing unit. The printing unit during the sheet printing process guides the printing sheet through the gap to the sheet discharging port.

In still another aspect, the present invention provides a printer device defined as above wherein the main body portion has a ribbon cassette window enabling an ink ribbon cassette loaded on the printing unit to be checked from outside when the lid is opened. The lid has a transparent portion for enabling the ribbon cassette window to be seen through from outside when the lid is closed.

In still another aspect, the present invention provides a printer device including (a) a main body portion having a printing unit, a sheet feed port for supplying printing sheets to the printing unit and an actuating switch controlling the operation of a control circuit adapted for driving the printing unit, and (b) a lid rotatably mounted on the main body portion (c) At a first rotational position, the lid closes the sheet feed port of the main body portion and hides the actuating switches for disabling the operation of the actuating switches. When at a second rotational position rotated a pre-set angle from the first rotational position, the lid does not hide the actuating switches for enabling the operation of the control circuit. When at the second rotational position, the lid supports the printing sheet supplied to the sheet feed port for guiding the sheet to the printing unit by driving means. The driving means has a feed roll and a pinch roll cooperating with each other upon insertion of the printing sheet for clamping the sheet for shifting the sheet in the fore and aft direction by the driving means.

In yet another aspect, the present invention provides a printer device including (a) a main body portion having a printing unit, a sheet feed port for supplying printing sheets to the printing unit and an actuating switch adapted for controlling the operation of a control circuit adapted for driving the printing unit, and (b) a lid rotatably mounted on the main body portion. (c) When at a first rotational position, the lid closes the sheet feed port of the main body portion and hides the actuating switches for disabling the operation of the actuating switches. When at a second rotational position rotated a pre-set angle from the first rotational position, the lid does not hide the actuating switches for enabling the operation of the control circuit. When at the second rotational position, the lid supports the printing sheet supplied to the sheet feed port for guiding the sheet to the printing unit by driving means. A planar flapper and a paper pan controlling the path of movement of the printing sheet are rotatably mounted ahead of a chassis frame of the printing unit.

With the printer device according to the present invention, no printing sheet can be inserted when the lid is closed, while actuating switches, such as a printer switch, are hidden by the closed lid.

Therefore, with the present printer device, the actuating switches may be prohibited from being actuated when the lid remains closed. Moreover, when the lid is closed, the actuating switches cannot be seen from outside and hence do not detract from design features of the printer device.

With the present printer device, the lid has the function of a sheet guide plate, so that the sheet guide plate can be opened or closed and hence the device may be reduced in size when the lid remains closed.

The printing unit of the printer device causes the printing sheet being printed to be moved via a sheet discharging port to a space between the transparent sheet guide plate and the lid plate portion, so that the state of the printing sheet being printed may be checked through the sheet guide plate.

The transparent portion provided in the lid allows the ribbon cassette window provided in the main body portion to be seen from outside on closure of the lid.

With the present printer device, the sheet feed port, sheet discharging port and the actuating switches of the main body portion are hidden by the lid, on lid closure, so that, if the lid is closed during non-use time, dust and dirt can be prohibited from being intruded into or deposited on the sheet feed port, sheet discharging port or on the actuating switches.

Thus, with the printer device of the present invention, the device can be reduced in size, and the state of the printing sheet being printed can be checked, while the printing sheet can be reliably guided within the main body portion of the device.

DESCRIPTION OF THE PREFERRED EMBODIMENTS

Figure 1:
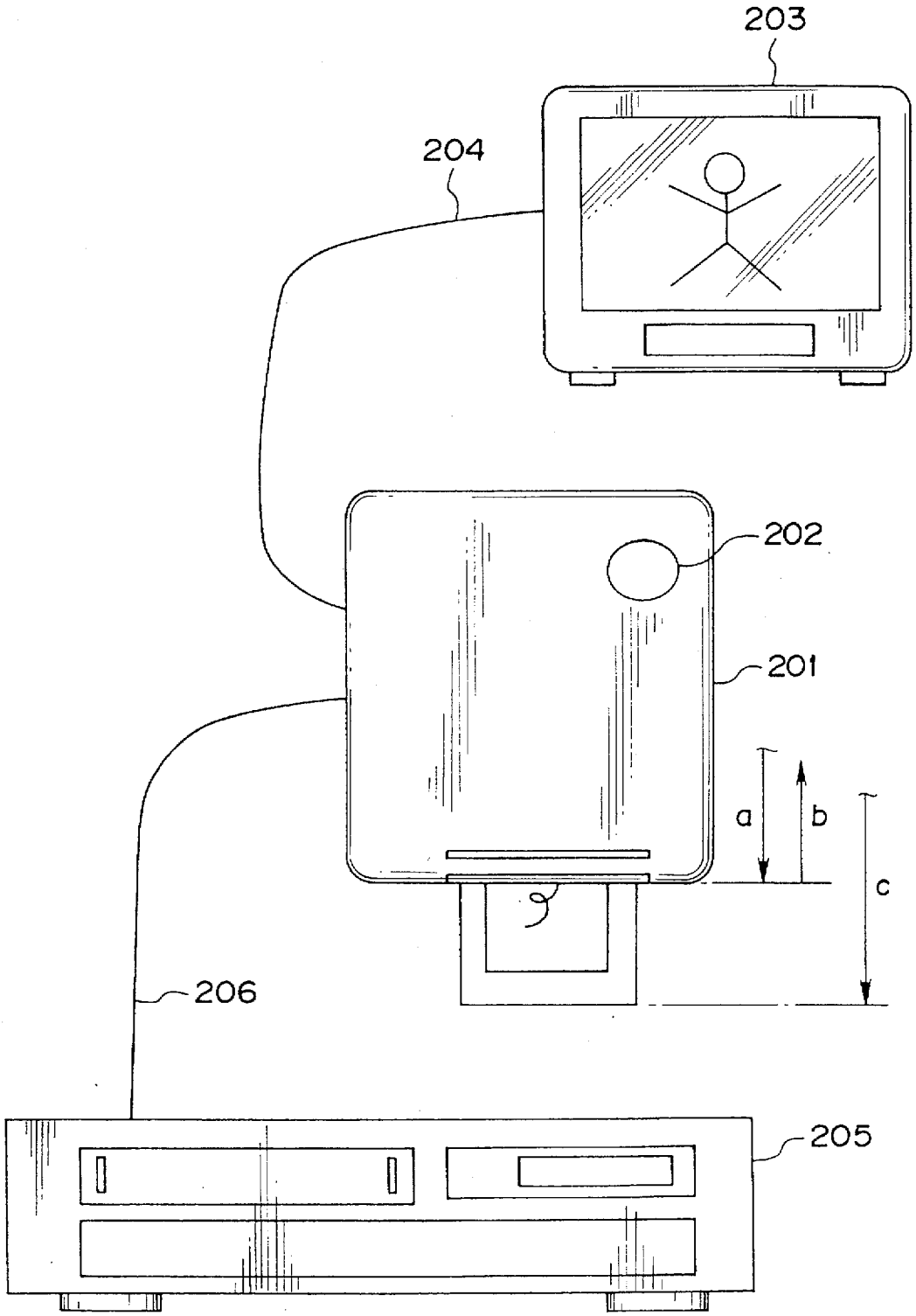
FIG. 1 is a plan view showing the structure of a conventional printer device and the state of connection of the printer device with other equipments.

Referring to the drawings, preferred embodiments of the present invention will be explained in detail.

The printer device according to the present invention includes a main body portion 20 having an outer casing enclosing a printing unit 93, as shown in FIGS. 2, 3 and 9 to 12.

Figure 8:
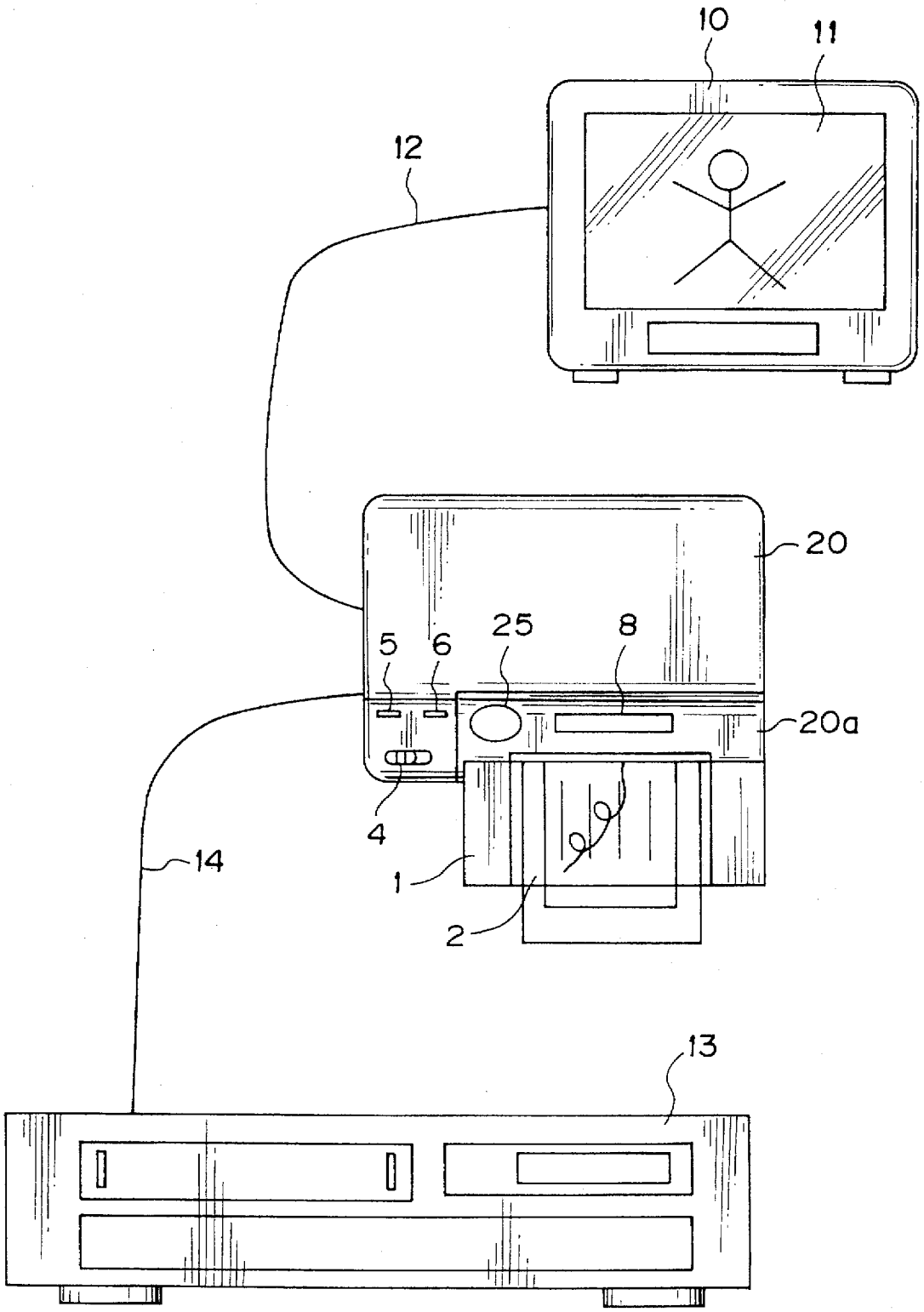
FIG. 8 is a plan view showing the state of connection of the printer device of FIG. 2 to other equipments.

This printer device is fed with video signals from a video reproducing device 13 over a first video cable 14, while supplying the video signals via a second video cable 12 to a video monitor device 10, as shown in FIG. 8. That is, the video signals from the video reproducing apparatus 13 are transferred via the printer device to the video monitor device 10.

The video reproducing apparatus 13 is a so-called video tape recorder or a video disc player. The video monitor device 10 is an apparatus corresponding to a video display portion of a television receiver, that is the portions of the television receiver excluding its tuner portion, and includes a cathode ray tube (CRT) or a liquid display plate.

An ink ribbon cassette 60 is inserted via a ribbon cassette inserting opening 24 provided on a lateral side of the main body portion 20. This ink ribbon cassette 60 is loaded on the printing unit 93.

Figure 2:
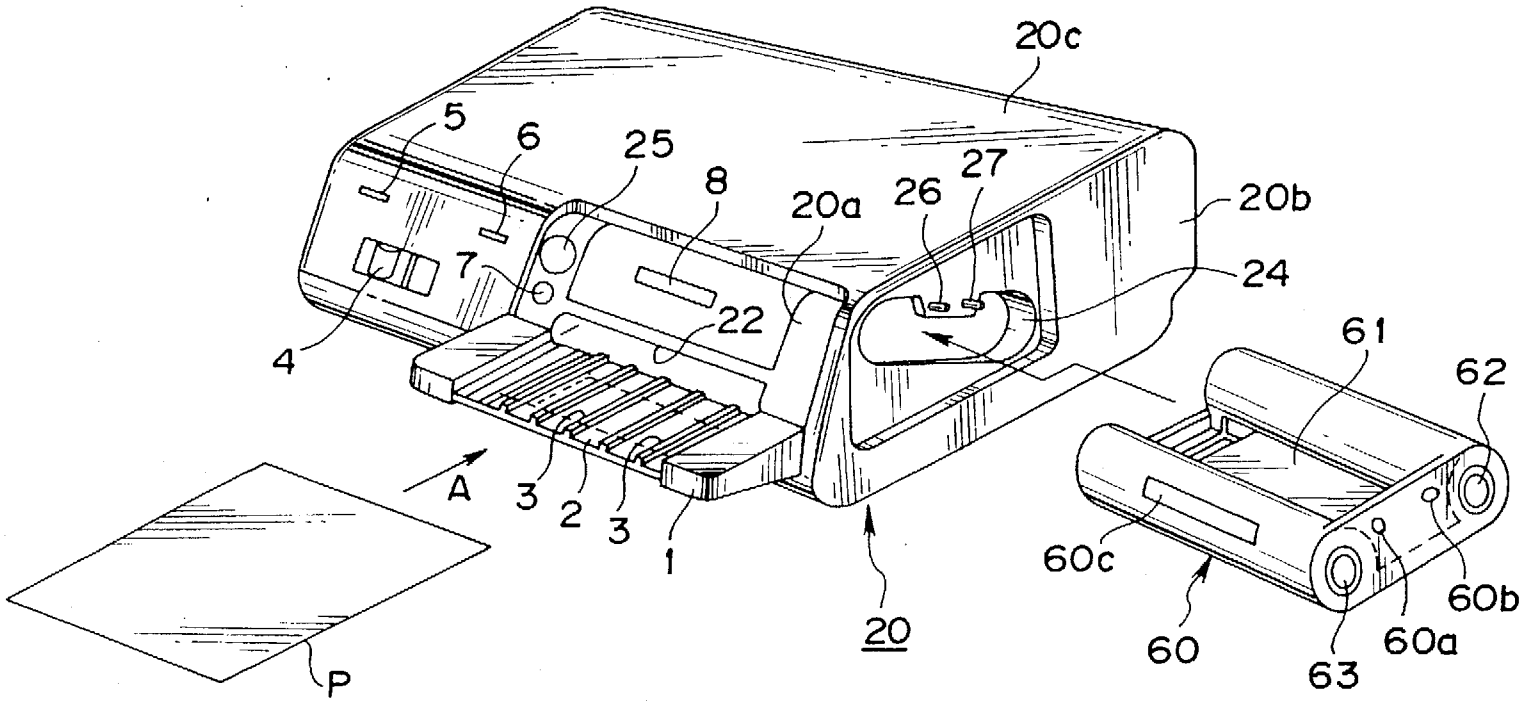
FIG. 2 is a perspective view showing the structure in the using state of a printer device according to the present invention.

The ink ribbon cassette 60 has a pair of cylindrically-shaped ribbon housing tubular portions. These ribbon housing tubular portions have their respective ends interconnected by a connecting plate portion and are supported parallel to each other, as shown in FIG. 2.

Within one of the ribbon housing tubular portions is rotatably housed a supply side ribbon reel 62. To a shank portion of the supply side ribbon reel 62 is connected a terminal portion of the ink ribbon 61. This ink ribbon 61 is coiled around the supply side ribbon reel 62. The beginning portion of the ink ribbon 61 is connected to the shank portion of a take-up side ribbon reel 63 rotatably accommodated in the other ribbon housing tubular portion.

When the take-up reel 63 is run in rotation, the ink ribbon 1 is taken up from the beginning end on this take-up reel 63 so as to be sequentially fed from the supply side ribbon reel 62 towards the take-up side reel 63. The portion of the ink ribbon 61 extending between the reels 62 and 63 has its both surfaces facing the outside of the ink ribbon cassette 60.

For this ink ribbon, a color ink ribbon having three colors of yellow (Y), magenta (M) and cyan (C), or four colors of yellow (Y), magenta (M), cyan (C) and black, arrayed and deposited thereon sequentially in areas registering with printing areas in the printer device, is employed.

With this ink ribbon, a monochromatic ink ribbon, having a sole black color ink deposited thereon, may also be used. The ink ribbon may also be a color ink ribbon having special color inks, such as gold or silver inks, deposited thereon.

The printer device effects printing on a sheet P having an area and a size corresponding to the printing area. The size may be about as large as a postcard, only by way of an example.

The above-described ink ribbon cassette 60, with a display specifying the type of the ink ribbon accommodated therein is provided on a display portion 60*c* provided on the outer peripheral surface of the opposite side ribbon housing tubular portion. This display portion 60*c* is designed to face the front side of the main body portion when the ink ribbon cassette 60 is housed within the main body portion 20 of the printer device.

Figure 3:
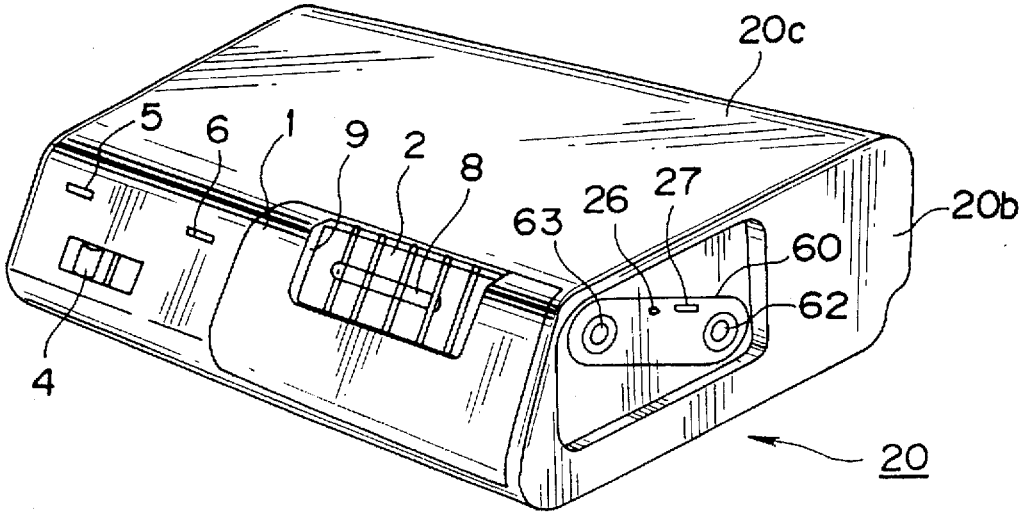
FIG. 3 is a perspective view showing the structure in the non-using state of the printer device shown in FIG. 2.
Figure 11:
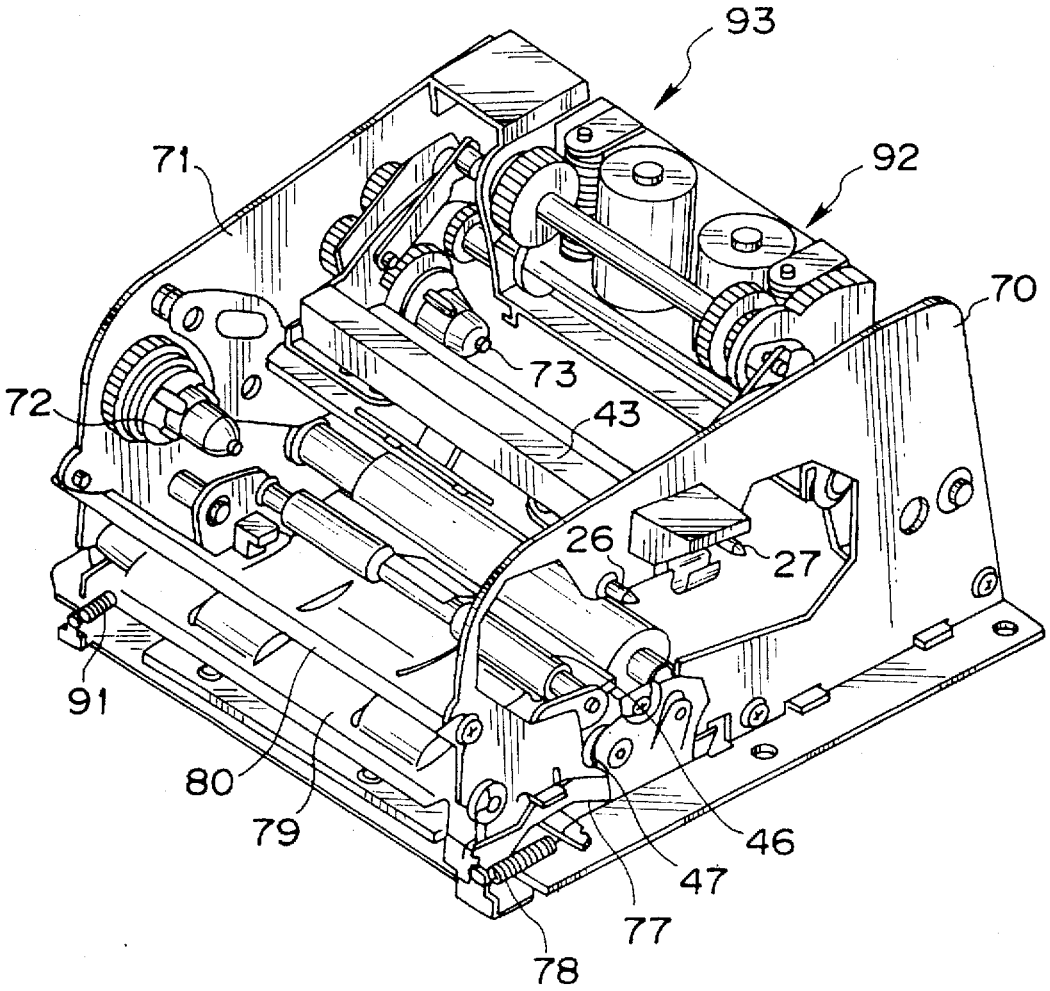
FIG. 11 is a perspective view showing the structure of essential portions of the printer device shown in FIG. 2.
Figure 12:
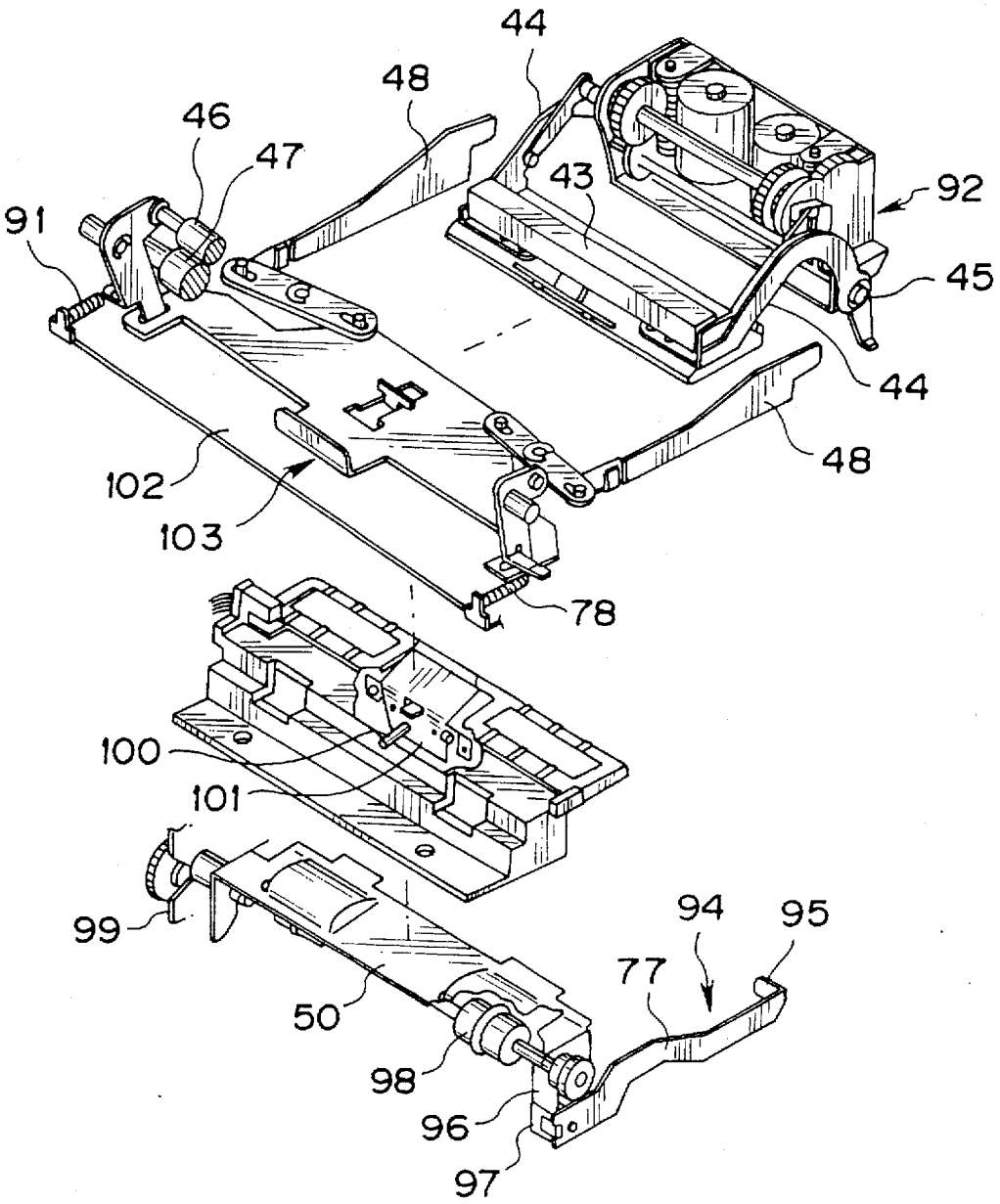
FIG. 12 is an exploded perspective view showing the structure of essential portions of the printer device shown in FIG. 2.

The connecting plate portion of the ink ribbon cassette 60 is formed with a pair of positioning holes 60*a*, 60*b*. When the ink ribbon cassette 60 is housed within the main body portion 20, these positioning holes 60*a*, 60*b* are engaged by a pair of positioning pins 26, 27 provided on the lateral surface of the main body portion 20 in the vicinity of the ribbon cassette insertion opening 24 for positioning the ink ribbon cassette 60 with respect to the main body portion 20, as shown in FIG. 3. The ink ribbon cassette 60, positioned within the main body portion 20, is supported with one of the ribbon housing tubular portions facing the rear side and with the opposite side ribbon housing tubular portion facing the front side, with the axis of each of the ribbon housing tubular portions lying horizontally. The printing unit 93 has a chassis frame comprised of a left side sidewall section 70 and a right side sidewall section 71, as shown in FIG. 11.

The sidewall section 70 is designed to extend along a lateral surface of the main body portion 20 and has a through-hole registering with the ribbon cassette inserting opening 24. Into this through-hole is inserted the ink ribbon cassette 60 inserted via the ribbon cassette inserting opening 24. The positioning pins 26, 27 are outwardly protuberantly formed on the sidewall section 70.

On the opposite sidewall section 71 are rotatably mounted a supply side reel shaft 73 and a take-up side reel shaft 72. These reel shafts 73, 72 are paired relative to each other and protruded towards the through-hole of the sidewall section 70.

These reel shafts 73, 72 are run in rotation by a motor, not shown. The motor rotation is controlled by a control circuit, not shown, provided in the main body portion 20.

When inserted into the ribbon cassette inserting opening 24, the ink ribbon cassette 60 is introduced into the through-hole in the sidewall section 70. When the positioning pins 28, 27 are inserted into the positioning holes 60*a*, 60*b* for positioning, the ribbon cassette 70 is loaded in position on the printing unit 93 by having the shank portion of the supply side ribbon reel 62 fitted to the supply side reel shaft 73 and by having the shank portion of the take-up side ribbon reel 63 fitted to the take-up side reel shaft 72.

On the chassis frame is mounted a thermal head 43 supported on a head arm 44. The head arm 44 has its proximal end rotatably supported via supporting shaft 45 on the chassis frame and carries at its distal end the thermal head 43. This head arm 44 is turned by a motor, not shown, controlled by the above control circuit.

Thus the ram head 43 is positioned above the ink ribbon cassette 60 loaded on the printing unit. By the turning movement of the head arm 44, the thermal head 43 may be moved into and out of contact with a portion of the ink ribbon 61 lying across the ribbon reels 62, 63.

The thermal head 43 has a width substantially equal to the width of the ink ribbon 61 and is provided with a plurality of heating elements arranged in a row within this width.

This thermal head 43 thrusts the ink ribbon 61, positioned on the sheet P, against the sheet P and heats the ink ribbon 61 by the heating elements for transcription of the ink on the ink ribbon 61 onto the sheet P.

With the thermal head 43 thus thrusting the ink ribbon 61 against the sheet P, the ink ribbon 61 and the sheet P are fed in a direction normal to the row of the heating elements of the thermal head 43, whilst the operating/non-operating timing of the heating elements is controlled depending on the video signals, for printing an image corresponding to the video signals on the sheet P.

The heating elements of the thermal head 43 are controlled responsive to the video signals by the above control circuit in association with the feed movement of the ink ribbon 61.

On the chassis frame is mounted a sheet feed unit for feeding the sheet P. The sheet feed unit is positioned below the ink ribbon cassette 60 loaded on the printing unit 93.

This sheet feed unit includes a feed roll 47, rotated by a motor controlled by the above control circuit, and a pinch roll 46 adapted for having rolling contact with the feed roll 47. The feed roll 47 and the pinch roll 46 are mounted with the axial directions thereof extending in the transverse direction, that is parallel to the axes of the ribbon rolls 62, 63 of the ink ribbon cassette 60 loaded on the printing unit 93. These rolls 47, 46 are substantially of the same length as the width of the ink ribbon 61.

When the sheet P is fed to the rolls 47, 46 from the front side, the rolls 47, 46 cooperate with each other for clamping the sheet P in-between. When the feed roll 47 is rotated by the above motor, the rolls 47, 46 cause the sheet P to be moved in the fore-and-aft direction.

At the back of the feed roll 47 is rotatably mounted a platen roll 41. This platen roll 41 is substantially equal in length to the feed roll 47 and mounted parallel thereto.

This platen roll 41 is mounted so that, when the thermal head 43 is moved towards the ink ribbon 61, the platen roll faces the thermal head 43 with the ink ribbon 61 in-between. That is, when the thermal head 43 is moved downwards, the thermal head 43 cooperates with the platen roll 41 to clamp the ink ribbon 61 in-between.

In the above printing unit 93, the sheet P moved by the feed roll 47 and the pinch roll 46 is intruded into a space between the ink ribbon 61 and the platen 41.

On the forward side of the chassis frame, there are rotatably mounted a planar flapper 50 and a paper pan 53 for controlling the path of movement of the sheet P. The flapper 50 is mounted for rotation about a rotary shaft extending parallel to the axis of the feed roll 47. The flapper 50 is rotated in association with rotation of the head arm 44 via a link 48 operatively connected to the proximal end of the head arm 44 and a flapper arm 49 operatively connected to the link 48.

Figure 9:
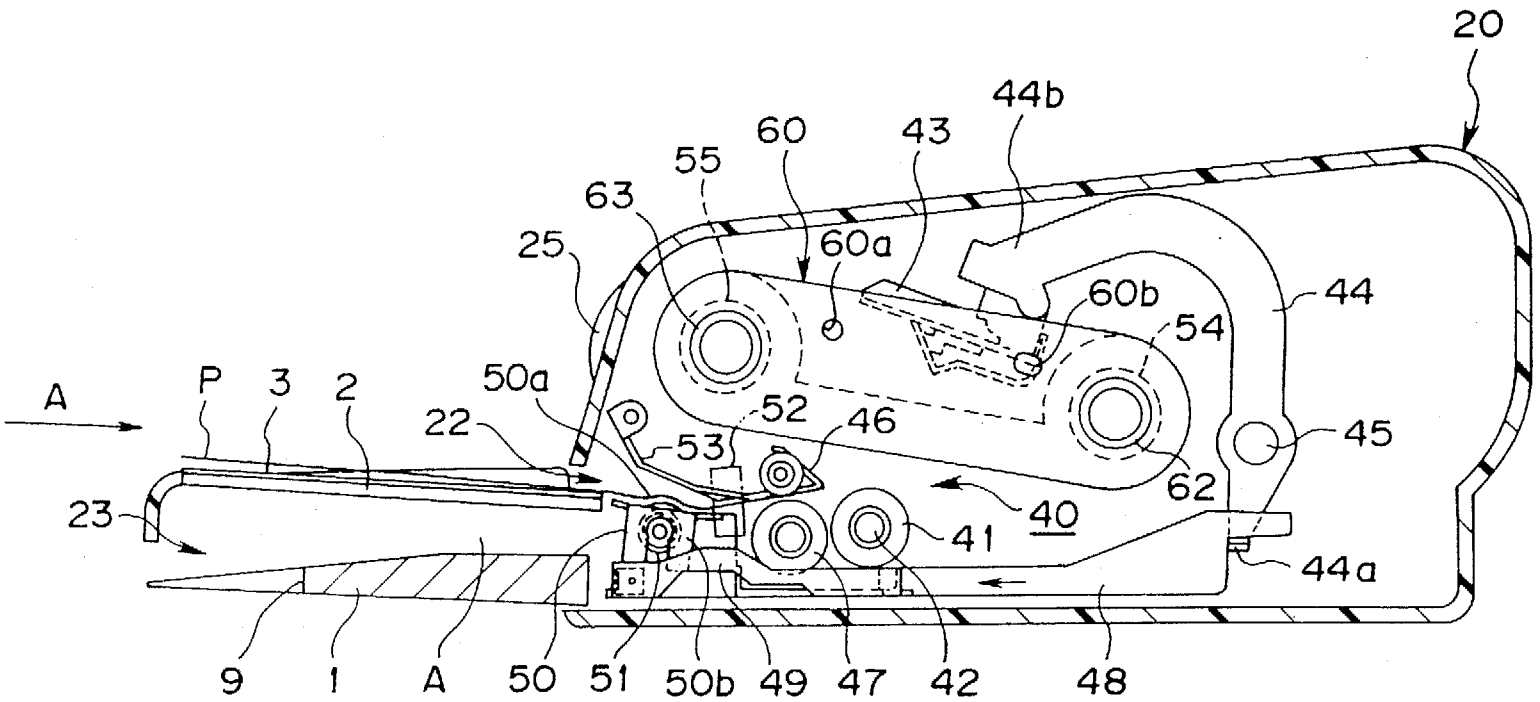
FIG. 9 is a longitudinal sectional view showing the structure in the sheet inserting state of the printer device of FIG. 2.
Figure 13:
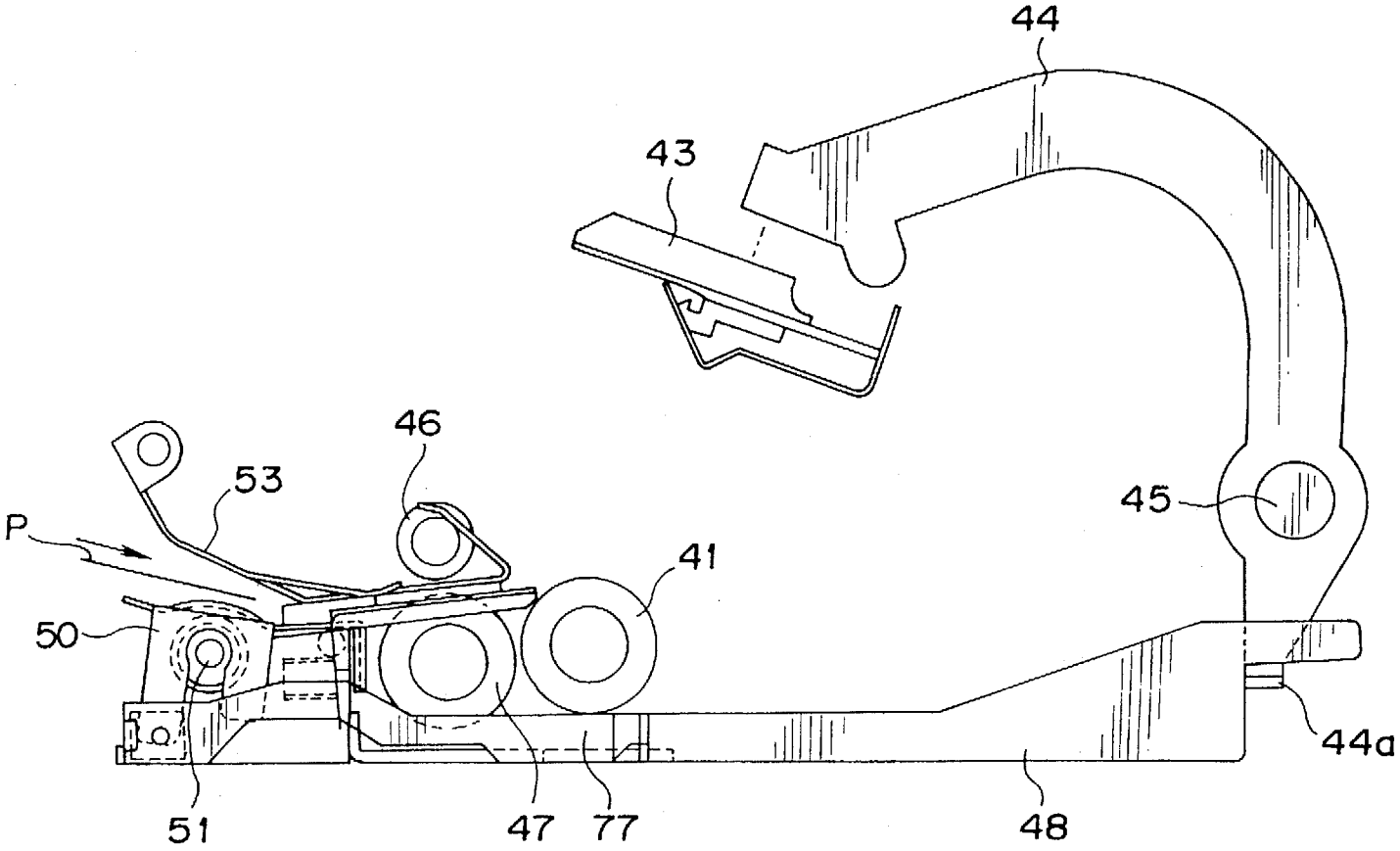
FIG. 13 is a side view showing the structure of essential portions in the sheet inserting state of the printer device.
Figure 15:
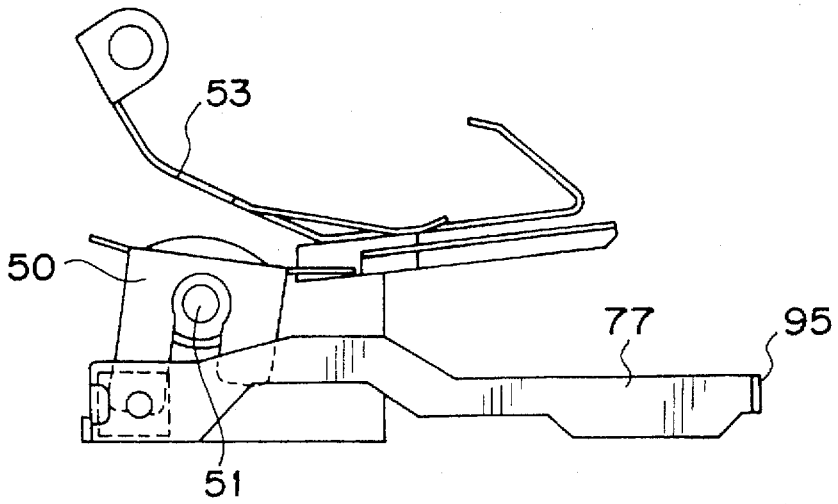
FIG. 15 is a side view showing the structure of the vicinity of a sheet inserting portion in the sheet inserting state of the printer device shown in FIG. 2.
Figure 16:
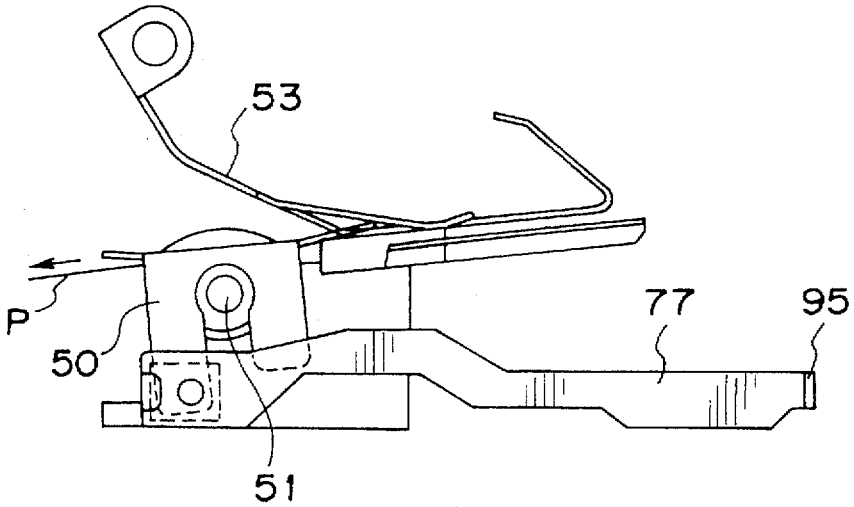
FIG. 16 is a side view showing the structure of the vicinity of a sheet inserting portion in the sheet discharging state of the printer device shown in FIG. 2.

When the thermal head 43 is spaced apart from the ink ribbon 61, the flapper 50 is turned so that its forward edge is directed obliquely upwardly, as shown in FIGS. 9, 13 and 15, so that the sheet P introduced from the forward obliquely upward side will be guided to a space between the feed roll 47 and the pinch roll 46.

Figure 10:
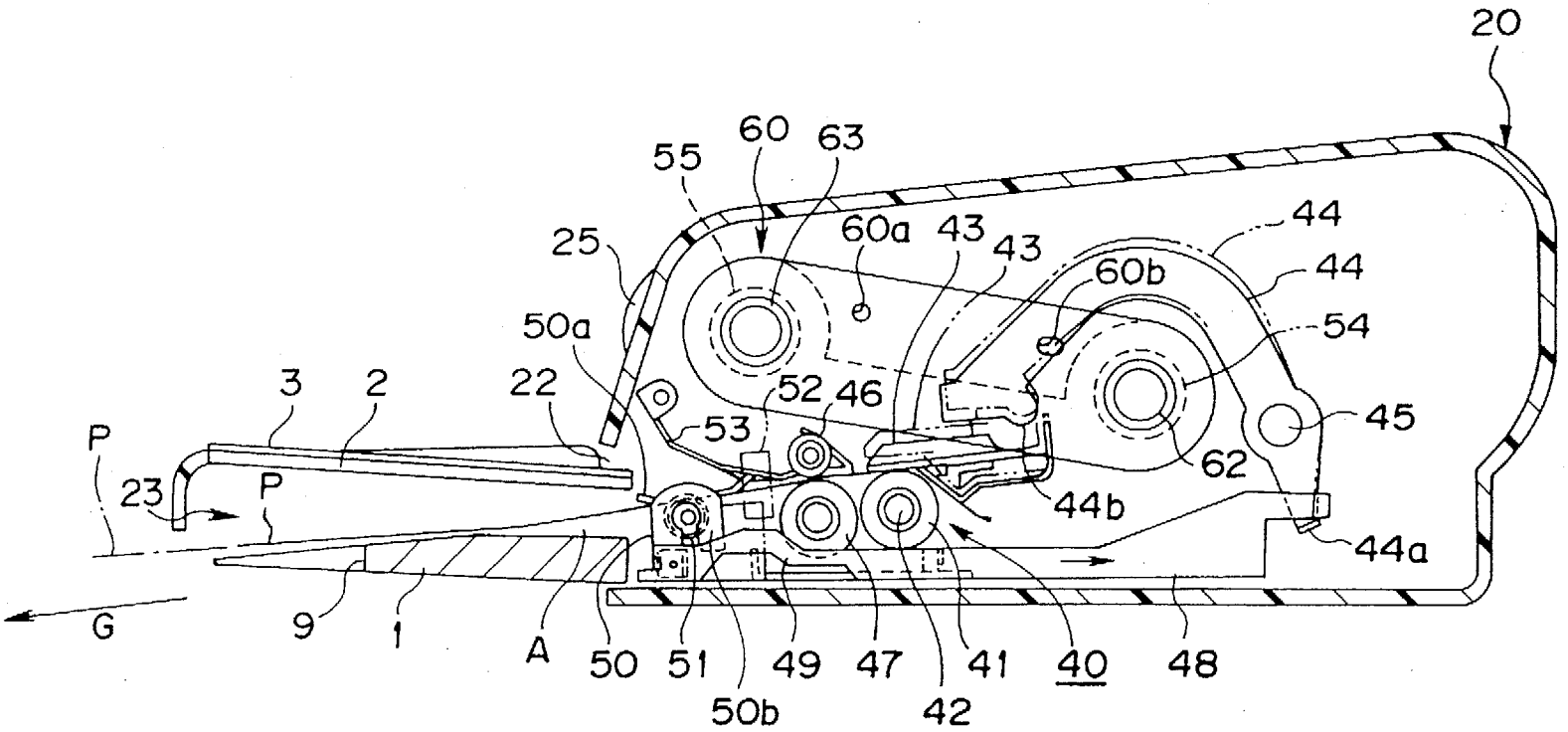
FIG. 10 is a longitudinal sectional view showing the structure in the sheet discharging state of the printer device of FIG. 2.
Figure 14:
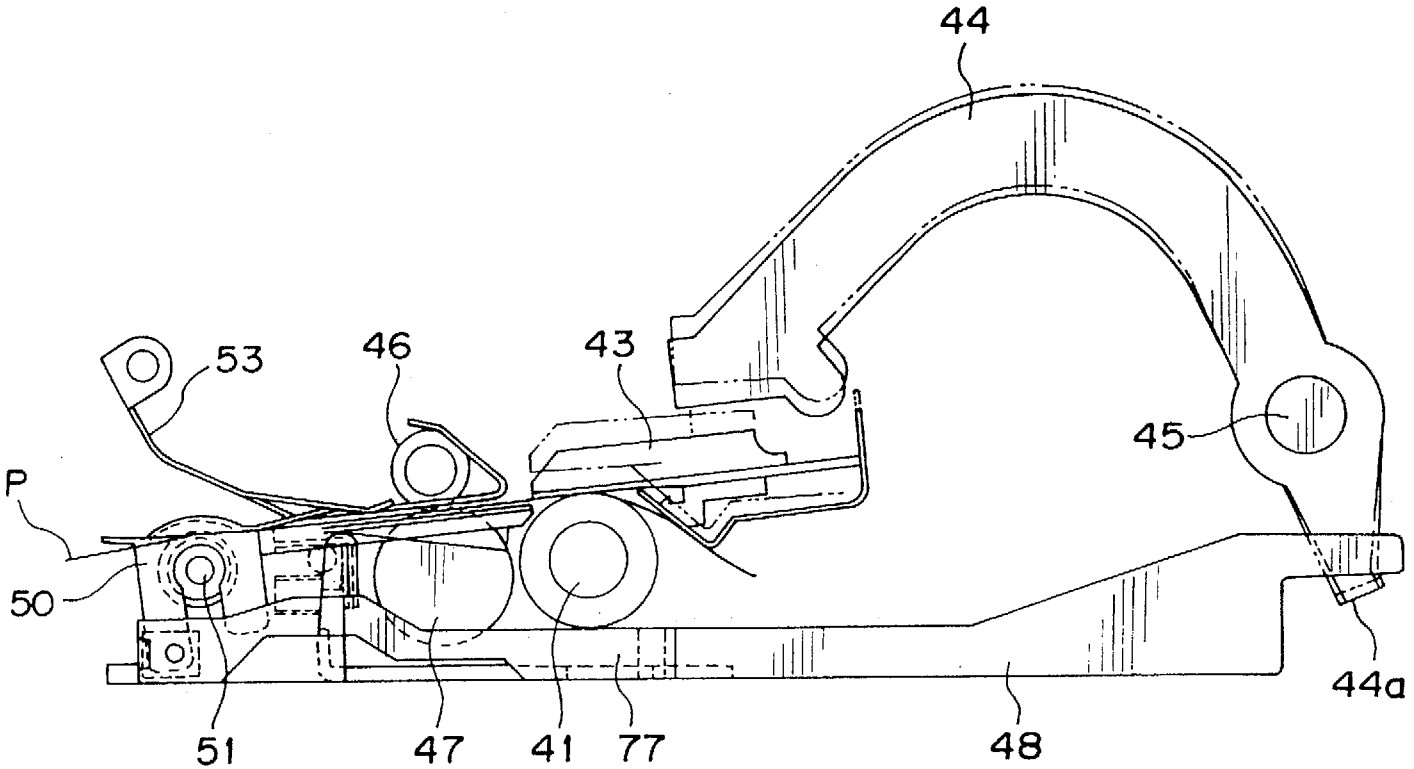
FIG. 14 is a side view showing the structure of essential portions in the sheet discharging state of the printer device.

When the thermal head 43 is abutted against the ink ribbon 61, the flapper 50 is turned so that its forward edge is directed obliquely downwardly, as shown in FIGS. 10, 14 and 18, so that the sheet P moved forwards as it is clamped between the feed roll 47 and the pinch roll 48 will be guided forwards in the obliquely downward direction.

On the flapper 50 is rotatably mounted a sheet discharge roll 51 run in rotation by a motor, not shown, controlled by the control circuit. The paper feed roll 51 is clamped between the feed roll 47 and the pinch roll 46 and feeds the sheet P further in the forward direction, as the sheet P clamped between the feed roll and the pinch roll 46 is moved in the forward direction, for discharging the sheet P from the printing unit 93.

On the flapper 50 is also mounted a sheet position sensor for sensing the possible presence of the sheet P in the printing unit 93 and the position of the forward end of the sheet P and sends the result of detection to the control circuit.

If the sheet P is introduced into the printing unit from the forward upper oblique position, the sheet P is clamped by the feed roll 47 and the pinch roll 46 so as to be fed in the rear direction to a printing start position. At this time, the thermal head 43 is spaced apart from the ink ribbon 61.

When the sheet P is at the printing position, the thermal head 43 is moved downwards and clamps the ink ribbon 61 and the sheet P in cooperation with the platen roll 41 for pressuring the ink ribbon 61 against the sheet P. At this time, the sheet P has its forward end portion clamped by the ink ribbon 61 and the platen roll 41.

The sheet P is then moved forwards by the feed roll 47 and the pinch roll 46. At this time, the ink ribbon 61 is fed in timed relation to the sheet P, while the thermal head 43 thrusts the ink ribbon 61 against the sheet P. At this time, the ink of the first color, such as yellow, is transcribed to the sheet P for printing the component of the first color of the printing image on the sheet P. Since the flapper 50 has its forward edge directed downwards at this time, the sheet P is moved in the forward obliquely downward direction.

The sheet P is again fed in the rear direction by the feed roll 47 and the pinch roll 46 and set to the above-mentioned printing start position. The thermal head 43 is spaced apart at this time away from the ink ribbon 61.

When the sheet P reaches the printing position a second time, the thermal head 43 is again moved downwards and cooperates with the platen roll 41 for clamping the ink ribbon 61 and the sheet P in-between for pressuring the ink ribbon 61 against the sheet P.

The sheet P is again moved forwards by the feed roll 47 and the pinch roll 46. The ink ribbon 61 is fed at this time in a timed relation to the sheet P, while the thermal head 3 thrusts the ink ribbon 61 against the sheet P. At this time, the ink of the second color, such as magenta, is transcribed to the sheet P for printing the component of the second color of the printing image on the sheet P. Since the flapper 50 has its forward edge directed downwards at this time, the sheet P is moved in the forward obliquely downward direction.

The sheet P is again fed in the rear direction by the feed roll 47 and the pinch roll 46 and set to the above-mentioned printing start position. The thermal head 43 is spaced apart at this time away from the ink ribbon 61.

When the sheet P reaches the printing position a third time, the thermal head 43 is again moved downwards and cooperates with the platen roll 41 for clamping the ink ribbon 1 and the sheet P in-between for pressuring the ink ribbon 61 against the sheet P.

The sheet P is then moved forwards by the feed roll 47 and the pinch roll 46. At this time, the ink ribbon 61 is fed in timed relation to the sheet P, while the thermal head 3 thrusts the ink ribbon 61 against the sheet P. At this time, the ink of the third color, such as cyan, is transcribed to the sheet P for printing the component of the third color of the printing image on the sheet P. Since the flapper 50 has its forward edge directed downwards at this time, the sheet P is moved in the forward obliquely downward direction.

This completes an image printed on the sheet P.

The sheet P, on which the image has been printed as described above, is discharged from the printing unit 93 by the paper discharging roll 51. Since the flapper 50 has its front edge directed obliquely downwards, the sheet P is moved in the forward obliquely downward direction.

In a front surface 20*a* of the main body portion 20, there is formed a paper feed port 22 facing the printing unit 93. This paper feed port 22 is positioned in a forward obliquely upward side with respect to the printing unit 93. When the sheet P is inserted via the paper feed port 22, the sheet P is inserted from the forward obliquely upper portion into the printing unit 93.

In the front surface 20*a* of the main body portion 20, below the paper feed port 22, there is formed a paper discharging port facing the printing unit 93. This paper discharging port is positioned in a forward obliquely downward side with respect to the printing unit 93. When the sheet P is discharged from the printing unit 93 in the forward obliquely downward direction, the sheet P is discharged to outside the main body portion 20 via the paper discharging port.

The main body portion 20 is provided with operating switches for actuating the printing unit 93, that is a memory switch 7 and a printing switch 25. The memory switch 7 and the print switch 25 are connected to the control circuit.

When the print switch 25 is pressed, the control circuit causes storage of one frame of video signals fed from the video reproducing apparatus 13 via the first video cable 14, and causes printing to be done on the sheet P inserted via the paper feed port 22 based on the stored video signals.

Moreover, on pressing the memory switch 7, the control circuit causes storage of one frame of video signals supplied from the video reproducing apparatus 13 over the first video cable 14. A printing image corresponding to the video signals stored on actuating the memory switch 7 is printed on pressing the printing switch 25.

The selection of the timing of pressing the print switch 25 or the memory switch 7, that is the selection of the video signals to be stored, may be done as the user views the picture displayed on the display unit 11 of the video monitoring device 10.

The front side 20*a* of the main body portion 20 has a ribbon cassette window 8 for enabling the display portion 60*c* of the ink ribbon cassette 60 housed within the main body portion 20 and loaded on the ink ribbon cassette 60 to be viewed from outside. That is, the display portion 60*c* of the ink ribbon cassette 60, loaded on the printing unit 93, may be viewed via the ribbon cassette window 8 from the front side of the main body portion 20.

On a lower portion of the front side 20*a* of the main body portion 20 is rotatably mounted a substantially planar lid made up of a lid plate portion 1 and a sheet guide plate 2. The lid has its lower edge pivotally supported by the outer casing of the main body portion 20 for opening or closing the paper feed port 22 as shown in FIGS. 2 and 3.

The sheet guide plate 2 is formed in a flat plate from a transparent material and has its both ends attached to the lid plate portion 1. The sheet guide plate 2 is attached to the lid plate portion for defining a gap 23 extending between the guide plate 2 and the lid plate portion 1 from the upper edge towards the lower edge of the lid plate portion 1.

Figure 4:
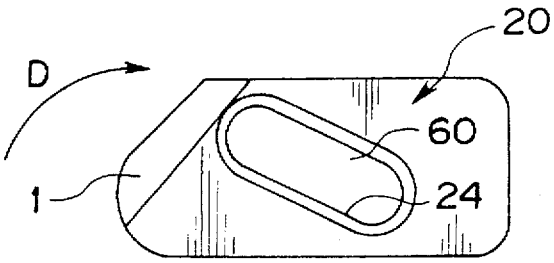
FIG. 4 is a side view showing the structure in the non-using state of the printer device shown in FIG. 2.
Figure 6:
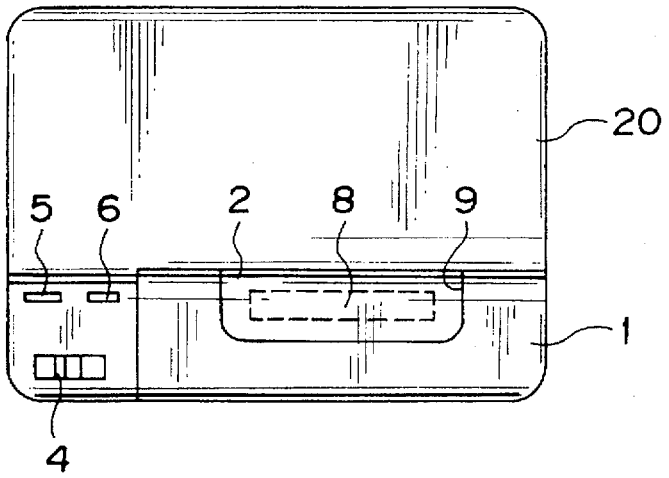
FIG. 6 is a plan view showing the structure in the non-using state of the printer device shown in FIG. 2.

When in the position of closing the paper feed port 22, the lid hides the ribbon cassette window 8, memory switch 7 and the print switch 28, as shown in FIGS. 3, 4 and 6.

Figure 5:
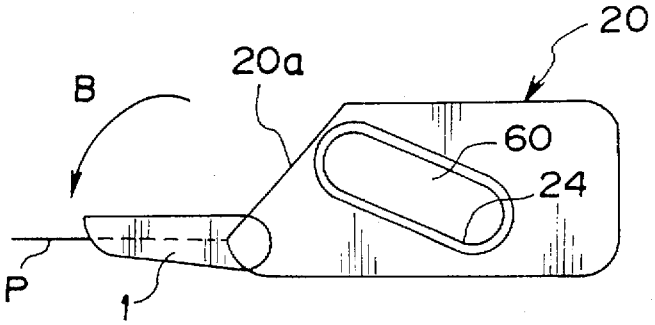
FIG. 5 is a side view showing the structure in the using state of the printer device shown in FIG. 2.
Figure 7:
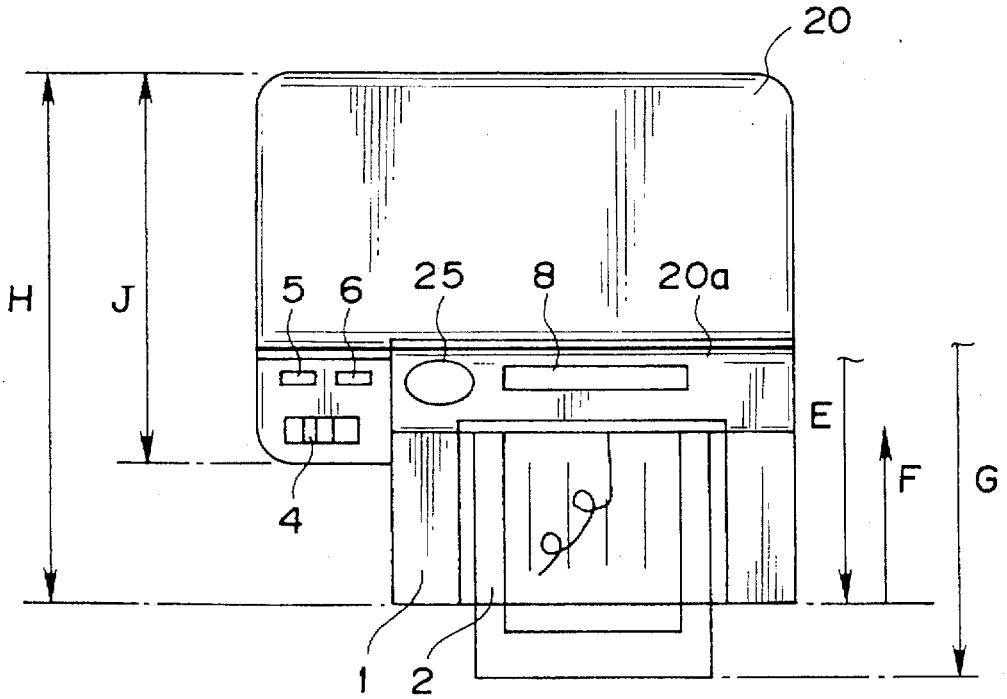
FIG. 7 is a plan view showing the structure in the using state of the printer device shown in FIG. 2.

When in the position of opening the paper feed port 22, the lid exposes the ribbon cassette window 8, memory switch 7 and the print switch 25 to outside to permit action on the memory switch 7 and the print switch 25, as shown in FIGS. 2, 5 and 7.

When the lid is opened, the ribbon cassette window 8 is exposed to outside, in order to permit the display portion 60*c* of the ink ribbon cassette 60, housed within the main body portion 20 and loaded on the printing unit 93, to be checked from outside.

When the paper feed port 22 is opened, the lid is substantially in a horizontal position, with the upper edge of the lid directing forwards.

The portion of the front side 20*a* of the main body portion 20 not hidden by the lid when the lid has closed the sheet feed port 22 is provided with a power source switch 4 and display lamps 5, 6 for power up and power down of the printer device. These display lamps 5, 6 display the power up state of the printer device and the state of printing going on, respectively.

In the above lid, a transparent portion is formed by the paper guide plate 2 and a cut-out 9 formed at an upper edge portion of the lid plate portion 1. The purpose of the transparent portion is to enable the ribbon cassette window 8 to be seen from outside on closure of the lid in order to permit the display portion 60*c* of the ink ribbon cassette 60 to be checked from outside via the ribbon cassette window 8, as shown in FIGS. 3 and 6.

That is, by forming the cut-out 9 in a portion of the lid plate 1 or by forming a portion of the lid plate 1 as a transparent plate for permitting the ribbon cartridge window 8 to be seen through the sheet guide plate 2 formed of a transparent material, the possible presence or the sort of the ink ribbon cartridge 60 within the main body portion 20 may be checked via the paper guide plate 2 and the ribbon cartridge window 8 not only when the lid is opened but also when the lid is closed.

In the non-use or non-printing state of the printer device, the lid may be closed, as shown by arrow D in FIGS. 3 and 4 and in FIG. 6, whereby the device is small-sized in depth in order to permit the device to be accommodated or transported as desired as shown by arrow J in FIG. 7. Moreover, in the use state or printing state of the printer device, the lid may be opened, as shown by arrow B in FIGS. 2 and 5 and in FIG. 7, for manifesting the sheet feed port 22, printer switch 25, memory switch 7 and the ribbon cartridge window 8 towards the front.

When the sheet feed port 22 is opened, the lid supports the sheet P supplied to the sheet feed port 22 by the upper surface of the sheet guide plate 2 and guides the sheet P up to the printing unit 93. The upper surface of the sheet guide plate 2 is formed with plural parallel guide ribs 3 directed towards the paper feed port 22.

The sheet guide plate 2 is designed to be co-planar with respect to the sheet feed port 22 in order to permit the sheet P to be easily inserted into the sheet feed port 22 on opening the lid.

The sheet guide plate 2 is adapted for inserting the sheet P in a direction perpendicular to the sheet feed port 22. For example, if the sheet P, such as a postcard, has a width of 100 mm, the sheet P can be inserted substantially at right angles to the sheet feed port 22 if ribs or walls are provided on both lateral sides of the sheet guide plate 2 and the width between the ribs is on the order of 102 mm.

If the sheet P is inserted into the sheet feed port 22 and the print switch 25 is pressed, the printing unit 93 starts its operation. The sheet P is automatically introduced into the printing unit 93 to initiate the above-mentioned printing operation. For color printing, the sheet P repeats the printing operations three times in order to effect three-color or four-color printing.

During the printing operating on the sheet P, supported by the sheet guide plate 2 and inserted in this state into the sheet feed port 22, the printing unit 93 shifts the sheet P being printed via the sheet discharging port to the gap 23 between the sheet guide plate 2 and the lid plate 1, as indicated by arrows E and F in FIG. 7. Since the sheet guide plate 2 is formed of a transparent material, the manner in which the sheet P is sequentially printed with respective colors may be checked from outside.

The forward edge of the sheet P is not protruded beyond the forwardly directed upper end of the lid. That is, with the lid in the opened position, the present printer device has such a depth as to cover the range of movement of the sheet P in the course of printing by the printing unit 93 as indicated by arrow H in FIG. 7.

After end of printing, the sheet P is discharged to a position ahead of the upper end of the lid, as indicated by arrow G in FIG. 7.

On both sides on the back surface of the lid, that is on both lateral planar sides of the surface of the lid facing the main body portion 20 on closure of the lid for supporting and guiding the sheet guide portion of the lid, or on the front surface 20*a* of the main body portion 20 directed to the front side on opening the lid, statements on the printing procedure or cautions may be inscribed for convenience to the user.

Since the statements on the printing procedure or cautions are not deleterious to the design of the printing device since it becomes invisible from outside on closing the lid during non-use time of the printer device.

Moreover, with the present printer device, since the lid needs to be opened for inserting the sheet P or pressing the print switch 25 for printing, the opening/closing movement of the lid may be operatively linked with the power switch for omitting the power switch 4. That is, in this case, the power source is automatically turned on by opening the lid for simplifying the operation.

With the present printer device, since the lid is closed except for printing, the sheet feed port 22, sheet discharging opening, print switch 25 or the memory switch 7, hidden by the lid, may be protected against intrusion or deposition of foreign matter.

We claim:

1. A printer device comprising:

(a) a main body portion having a printing unit, a sheet feed port on a front surface of the main body portion for supplying printing sheets to said printing unit and at least one actuating switch adapted for controlling the operation of a control circuit adapted for driving the printing unit; and (b) a lid rotatably mounted on a lower portion of the front side of said main body portion;

(c) said lid at a first rotational position having a major vertical component and closing said sheet feed port of said main body portion and hiding said actuating switches for disabling the operation of the at least one actuating switch;

(d) said lid at a second rotational position having a major horizontal component and rotated a pre-set angle from said first rotational position not hiding the actuating switches for enabling the operation of the control circuit;

(e) said lid at said second rotational position supporting the printing sheet supplied to said sheet feed port for guiding the sheet to said printing unit by driving means.

2. The printer device as claimed in claim 1 wherein said main body portion has a sheet discharging port below said sheet feed port in the vicinity of said printing unit;

said lid having a lid plate portion and a guide portion formed at a distance for forming a gap on said lid plate portion; said guide portion supporting the printing sheet supplied to the sheet supply port and guiding the sheet to said printing unit;

said printing unit during the sheet printing process guiding the printing sheet through said gap to said sheet discharging port.

3. The printer device as claimed in claim 1 wherein said main body portion has a ribbon cassette window enabling an ink ribbon cassette loaded on the printing unit to be checked from outside when the lid is opened;

said lid having a transparent portion for enabling the ribbon cassette window to be seen through from outside when the lid is closed.

4. The printer device as claimed in claim 1 wherein said driving means has a feed roll and a pinch roll cooperating with each other on insertion of the printing sheet for clamping the sheet for shifting the sheet in the fore and aft direction by said driving means.

5. The printer device as claimed in claim 1 wherein a planar flapper and a paper pan controlling the path of movement of said printing sheet are rotatably mounted ahead of a chassis frame of said printing unit.

6. The printer device as claimed in claim 5 wherein, if a thermal head of the printing unit is spaced apart from the ink ribbon, said flapper is turned so that its forward edge is directed in a forward obliquely upward direction for guiding the printing sheet inserted from the front side to a space between the feed roll and the pinch roll.

7. The printer device as claimed in claim 5 wherein, if a thermal head of the printing unit is abutted against the ink ribbon, said flapper is turned so that its forward edge is directed in a forward obliquely downward direction for guiding the printing sheet in a forward obliquely lower direction as the printing sheet is clamped between the feed roll and the pinch roll.

8. The printer device as claimed in claim 5 wherein said flapper has a paper discharging roll rotatably mounted thereon for further moving the printing sheet clamped between and moved by the feed roll and the pinch roll so as to be discharged out of the printing unit.

9. A printer device comprising:

(a) a main body portion having a front surface, a printing unit substantially within said main body portion; a sheet feed port facing the printing unit and positioned in a forward obliquely upward side with respect to the printing unit, a plurality of operating switches at least for actuating the printing unit, a paper discharging port facing the printing unit and positioned in a forward obliquely downward side with respect to the printing unit, and a ribbon cassette window for enabling a display portion of an ink ribbon cassette housed within the main body portion to be viewed from outside the main body;

(b) a lid having a lid plate portion and a sheet guide plate rotatably mounted on a lower portion of the front side of the main body portion, a lower edge of said lid being pivotally supported by the outer casing of the main body portion for opening or closing the sheet feed port, (c) said lid at a first rotational position closing said sheet feed port of said main body portion and hiding said actuating switches for disabling the operation of the actuating switches;

(d) said lid at a second rotational position rotated a pre-set angle from said first rotational position not hiding the actuating switches for enabling the operation of the control circuit, said lid at said second rotational position supporting the printing sheet supplied to said sheet feed port for guiding the sheet to said printing unit by driving means.

10. The printer device as claimed in claim 9 wherein said discharging port is positioned below said sheet feed port in the vicinity of said printing unit;

said lid plate portion and said guide portion formed at a distance for forming a gap on said lid plate portion;

said guide portion supporting the printing sheet supplied to the sheet supply port and guiding the sheet to said printing unit;

said printing unit during the sheet printing process guiding the printing sheet through said gap to said sheet discharging port.

11. The printer device as claimed in claim 10 wherein said lid having a transparent portion for enabling the ribbon cassette window to be seen through from outside when the lid is closed.

12. The printer device as claimed in claim 9 wherein said driving means has a feed roll and a pinch roll cooperating with each other on insertion of the printing sheet for clamping the sheet for shifting the sheet in the fore and aft direction by said driving means.

13. The printer device as claimed in claim 9 wherein a planar flapper and a paper pan controlling the path of movement of said printing sheet are rotatably mounted ahead of a chassis frame of said printing unit.

14. The printer device as claimed in claim 13 wherein, if a thermal head of the printing unit is spaced apart from the ink ribbon, said flapper is turned so that its forward edge is directed in a forward obliquely upward direction for guiding the printing sheet inserted from the front side to a space between the feed roll and the pinch roll.

15. The printer device as claimed in claim 13 wherein, if a thermal head of the printing unit is abutted against the ink ribbon, said flapper is turned so that its forward edge is directed in a forward obliquely downward direction for guiding the printing sheet in a forward obliquely lower direction as the printing sheet is clamped between the feed roll and the pinch roll.

16. The printer device as claimed in claim 13 wherein said flapper has a paper discharging roll rotatably mounted thereon for further moving the printing sheet clamped between and moved by the feed roll and the pinch roll so as to be discharged out of the printing unit.

17. A printer device comprising:

(a) a main body portion having a front surface, a printing unit substantially within said main body portion; a sheet feed port facing the printing unit, a plurality of operating switches at least for actuating the printing unit, a paper discharging port communicating with the printing unit, and a ribbon cassette window for enabling a display portion of an ink ribbon cassette housed within the main body portion to be viewed from outside the main body;

(b) a lid having a lid plate portion and a sheet guide plate rotatably mounted on a lower portion of the front side of the main body portion, a lower edge of said lid being pivotally supported by the outer casing of the main body portion for opening or closing the paper feed port;

(c) said lid at a first rotational position closing said sheet feed port of said main body portion and hiding said actuating switches for disabling the operation of the actuating switches;

(d) said lid at a second rotational position rotated a pre-set angle from said first rotational position not hiding the actuating switches for enabling the operation of the control circuit, said lid at said second rotational position supporting the printing sheet supplied to said sheet feed port for guiding the sheet to said printing unit by driving means, said like having a trasnparent portion for enabling the ribbon cassette window to be seen through from outside when the lid is closed.

18. The printer device as claimed in claim 17 wherein said lid includes a lid plate portion and a guide portion formed at a distance for forming a gap on said lid plate portion;

said guide portion supporting the printing sheet supplied to the sheet supply port and guiding the sheet to said printing unit;

said printing unit during the sheet printing process guiding the printing sheet through said gap to said sheet discharging port.

* * * * *